United States Patent [19]

Jatczak et al.

[11] 4,032,369

[45] June 28, 1977

[54] METHOD FOR QUENCHING FERROUS TUBING TO ACHIEVE FULL HARDENING WITHOUT QUENCH CRACKING

[75] Inventors: Chester F. Jatczak; Richard W. Brown, both of North Canton, Ohio

[73] Assignee: The Timken Company, Canton, Ohio

[22] Filed: Feb. 2, 1976

[21] Appl. No.: 654,601

[52] U.S. Cl. ..... 148/143; 148/145; 148/153; 148/157

[51] Int. Cl.[2] ..... C21D 9/08

[58] Field of Search ..... 148/143, 153, 157, 145

[56] References Cited

UNITED STATES PATENTS 3,212,766 10/1965 Heinenberg et al. ..... 148/143

*Primary Examiner*—R. Dean

*Attorney, Agent, or Firm*—Brown, Murray, Flick and Peckham

[57] ABSTRACT

A method for bringing a quenching medium into contact with both the inner and outer wall surfaces of metallic tubing, characterized in that a quenching liquid is fed into the interior of the tubing and pressurized, followed by quenching of the outer wall surface, preferably by immersion in a tank containing a quenching liquid. Pressurization of the quenching liquid fed into the interior of the tubing insures uniform wall contact of the liquid around the inner wall surface and along the entire length of the tubing. This brings about uniform hardness characteristics throughout the thickness of the tube walls and along its entire length and eliminates or reduces quench-crack problems inherent in prior art quenching systems wherein the quenching medium within the tubing is not pressurized.

5 Claims, 2 Drawing Figures

Figure 1:
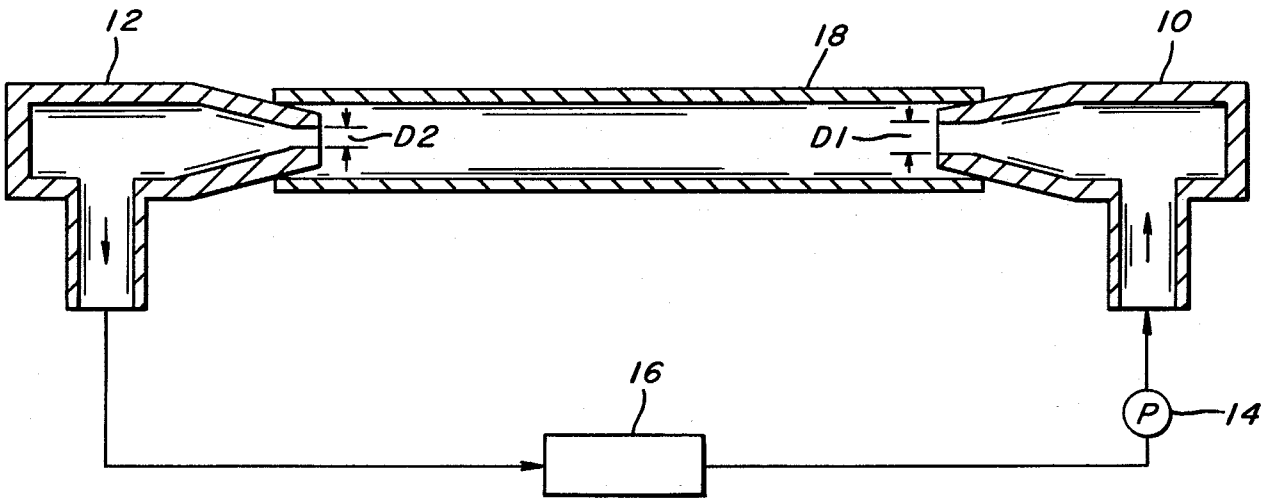

METHOD FOR QUENCHING FERROUS TUBING TO ACHIEVE FULL HARDENING WITHOUT QUENCH CRACKING

BACKGROUND OF THE INVENTION

Tubing used for oil well casings and drill pipe, for example, must have superior strength and hardness characteristics. This can be achieved with the use of high alloy steels, but such steels are expensive.

In order to harden and strengthen low alloy steels, processes have been developed in the past for quenching both the inner and outer surfaces of the tubing; but these prior art practices do not uniformly quench the inner surface of the tubing, resulting in non-uniform hardness along the cross section of the tubing wall, non-uniform hardness along the length of the tubing, and quench-cracking due to the non-uniform hardness characteristics.

Some prior art systems employ a free-flowing stream of quenching liquid flowing along the inner wall surface of a tube while it is in a vertical position, followed by quenching of the outer surface. Other prior art systems attempt to quench with the use of a circumferential outside diameter spray ring or longitudinal spray bars. This not only fails to achieve quenching of the inner surface but also requires water volumes of up to 5000 gallons per minute. Still another prior art method for quenching both the inner and outer wall surfaces of tubing is that shown, for example, in Heinenberg U.S. Pat. No. 2,888,374. In that patent, a quenching system is described wherein a cooling liquid is introduced into the tube in a vortical manner rather than as a free-flowing stream. While this system is perhaps better than the free-flowing quenchant system for interior wall quenching, the vortical water stream does not stay in contact with the inner wall of the tubing throughout its length. This results in non-symmetrical quenching of the inside diameter of the tubing since, in a typical 40-foot tube for example, drag between the quenchant liquid and the inner wall of the tube will reduce the speed of the quenchant which will, in turn, reduce the centrifugal force acting on it. As a consequence, the quenchant falls away from the inner diameter of the tube at the end opposite an injection nozzle which produces the vortical motion. The result is that the bottom half of the far end of the tube is quenched on its inner diameter while the top half of the inner diameter is not

SUMMARY OF THE INVENTION

In accordance with the present invention, a new and improved method for quenching ferrous tubing is provided which achieves full hardening without quench-cracking and at the same time requires a maximum of only about 200 to 400 gallons of quenching liquid per minute in contrast to prior art quench ring units which require from 4000 to 5000 gallons per minute to quench the outer wall of the tubing alone. At the same time, the invention is capable of quenching tubing having wall thicknesses ranging from ¼ inch to 4 inches.

Specifically, in accordance with the invention, a method is provided for bringing a quenching medium into contact with both the inner and outer wall surfaces of heated metallic tubing, comprising the steps of introducing a quenching liquid into the interior of the tubing and pressurizing the same whereby the quenching liquid will uniformly contact the entire inner wall surface of the tubing, and thereafter bringing the outer surface of the tubing into contact with a quenching liquid. Preferably, the outer wall surface of the tubing is quenched by immersion in a tank containing the quenching liquid. Injecting the quenching liquid into the interior of the tubing before immersion of the outer wall surface is necessary since the inner surface has less area exposed to the quenching liquid than the outer surface, meaning that the cooling times will be longer.

By utilizing the invention, a full, uniform and symmetrical hardness results throughout the tube wall and throughout the length of the tube, and quench-crack problems which heretofore plagued quench systems of this general type are materially reduced or eliminated. In addition, the system of the invention provides the most rapid quenching rates for tubing known to-date. As a consequence, much heavier sections of any given steel can be satisfactorily hardened than with any other quenching method, meaning that lower alloyed steels can be used in place of more costly high alloyed steels in heavywalled tubing.

Figure 2:
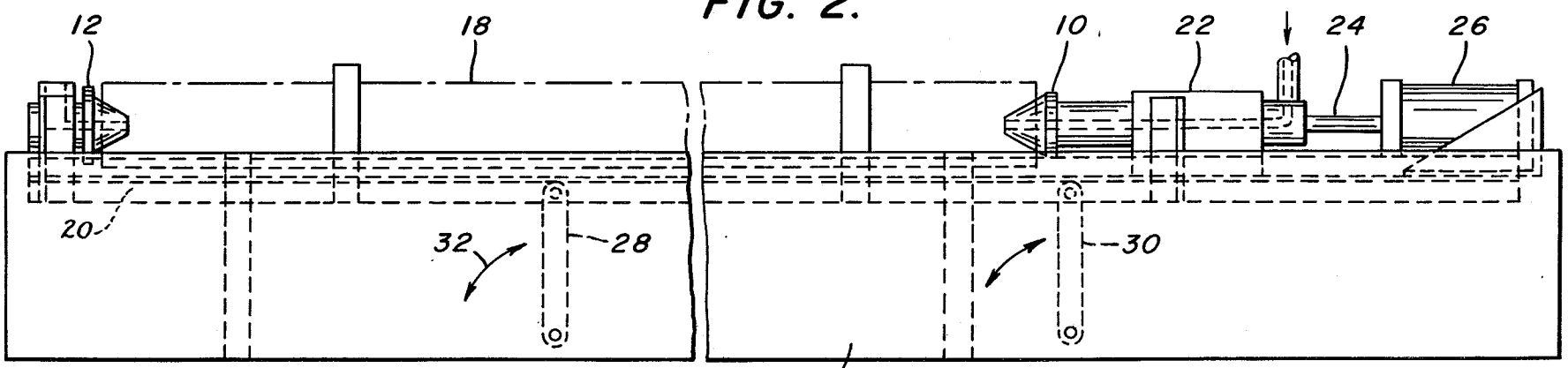

The above and other objects and features of the invention will become apparent from the following detailed description taken in connection with the accompanying drawings which form a part of this specification, and in which:

FIG. 1 is a schematic illustration of one type of quenching rig that can be used in accordance with the invention; and FIG. 2 is a more detailed view of the quenching rig showing the manner in which tubing is immersed in a quenching tank after its interior is filled with pressurized liquid.

With reference now to the drawings, and particularly to FIGS. 1 and 2, the quenching rig shown includes an entrance nozzle 10, an exit nozzle 12 and a pump 14 for pumping a quenching liquid, preferably water, from a quench tank 16 to the entrance nozzle 10. Quenching liquid flowing through the exit nozzle 12 is returned back to the quench tank 16, best shown in FIG. 2, where it is again recirculated by the pump 14.

The diameter D1 of the discharge orifice in the entrance nozzle 10 is larger than the diameter D2 of the orifice in the exit nozzle 12. Consequently, as water from the pump 14 flows through a tube 18 into which the nozzles 10 and 12 have been inserted, it will be pressurized and will fill the entire volume of the tubing so as to bring the quenching liquid into intimate contact with both the bottom and top portions of the inside wall surface. Note that the tapered configuration of the nozzles 10 and 12, where they fit into the ends of the tube 18, permits the quenching liquid to flow into contact with the inner wall surface to its very ends. The tapered configuration of the nozzles 10 and 12 also permits the use of one pair of nozzles for a large range of tube I.D. sizes.

A typical quenching arrangement is shown in more detail in FIG. 2. The nozzles 10 and 12 are mounted on a cradle fixture 20 which receives tubes which are to be quenched. The nozzle 10 is carried by a reciprocable fixture 22 mounted on the cradle 20 and is connected to the piston rod 24 of an air of hydraulic cylinder 26, also carried on the cradle 20. The cradle 20, the nozzles 10 and 12, the fixture 22 and the cylinder 26 are all carried by pivoted arms 28 and 30 which can pivot along the direction of arrows 32 from the vertical positions shown to horizontal positions whereby the cradle, the nozzles 10 and 12 and the tube 18 carried therebetween are immersed in quenching liquid carried within the quench tank 16.

In operation of the device, a tube, such as tube 18, after being heated to about 1525° F, is moved onto the cradle 20 by automatic conveying equipment, not shown. Thereafter, a quenching liquid is injected into the interior of the tube through the inlet nozzle 10. By virtue of the difference in the diameters of the nozzle bores explained above, the fluid within the tube will become pressurized and will contact the entire inner wall surface of the tube. In a typical example, water from an 800-gallon per minute centrifugal pump will be injected into and flow through the tube 18 at a pressure of about 25 pounds per square inch. After about ten seconds following the initiation of injection of water into the interior of the tube, the arms 28 and 30 are actuated by suitable actuators, not shown, to move into horizontal positions, thereby lowering the cradle 20 and the tube 18 which it carries into the quenching liquid within the tank 16. After immersion in the tank 16 for about 75 to 120 seconds, the arms 28 and 30 are actuated to elevate the cradle and the tube 18; the nozzle 10 is withdrawn from the end of the tube by cylinder 26; and the tube is then removed by automatic conveying equipment preparatory to quenching a succeeding tube. It should be understood that the above immersion times are for a typical example. Total immersion time depends on the wall thickness. Heavier walled tubes require more time to cool satisfactorily.

In order to illustrate the desirable results of the invention, tubing in the size range of about 5 to 5.75 inches outside diameter and 1.44 to 1.81 inch wall thickness was quenched in lengths of 16 feet 8 inches after being heated at 1525° F for 4 to 6 hours and tempered as indicated below:

| Heat No. | Temp. ° F | Hardening Time | SAE Steel Type | Tube Size |
|---|---|---|---|---|
| 41829 | 1525 | 4 hours | 4145 | 5.0" O.D. × 1.44" Wall |
| 41936 | 1525 | 5 hours | 4150 | 5.81" O.D. × 1.41" Wall |
| 61835 | 1525 | 6 hours | 4340 | 5.75" O.D. × 1.81" Wall |

| I.D./O.D. Que. Time, Sec. | Temper Temp. ° F | Temp. Times |
|---|---|---|
| 10* + 75 = 85 | 1080 | 6 hours |
| 10 + 75 = 85 | 1080 | 6 hours |
| 15 + 120 = 135 | 960 | 8 hours |

*This denotes pre-bore lead time in the combined I.D./O.D. quench cycle.

Tensile and impact properties were measured on each of the tubes at the near outside diameter, near inside diameter and center locations of the tube wall on a section cup two feet from the exit end. The results are shown in the following Table I:

TABLE I

Mechanical Properties in Production Tubing
Water Quenched on Plug I.D./O.D. Quench Rig A. 4145 Steel, 5.0" O.D. × 1.44" Wall, Austenitized 1525° F, I.D./O.D. Quenched, Tempered at 1080° F (.357" Tensiles and Standard .394" "V" Notch Charpys Taken at O.D., Center and I.D. Wall Locations, Two Feet from Exit End of Tube.

| Tube | Test Position | .2% Yld. Str. KSI | Ultimate Ten. Str. KSI | Red. of Area % | El. % | Yld./Ten. Ratio | R.C. Hardness | Charpy in./ft. | Charpy lbs. |
|---|---|---|---|---|---|---|---|---|---|
| O.D. | 1 | 140.0 | 159.6 | 57.4 | 17.9 | 0.88 | 34.0 | 52.0 | 51.5 |
| | 2 | 141.1 | 159.0 | 55.8 | 17.4 | 0.88 | 34.5 | 51.0 | 51.0 |
| | 3 | 138.6 | 157.5 | 55.5 | 17.4 | 0.88 | 34.0 | 50.0 | 51.5 |
| C. | 1 | 137.0 | 156.4 | 56.6 | 17.9 | 0.88 | 34.0 | 51.0 | 47.0 |
| | 2 | 138.0 | 157.9 | 54.4 | 17.9 | 0.87 | 33.5 | 51.0 | 50.0 |
| | 3 | 139.0 | 156.5 | 58.3 | 17.9 | 0.89 | 34.0 | 51.0 | 48.0 |
| I.D. | 1 | 140.4 | 159.6 | 57.4 | 17.9 | 0.88 | 34.0 | 53.0 | 54.5 |
| | 2 | 141.1 | 159.0 | 55.8 | 17.4 | 0.89 | 34.5 | 54.5 | 55.0 |
| | 3 | 138.6 | 157.5 | 55.5 | 17.4 | 0.88 | 34.0 | 57.0 | 54.0 |

B. 4150 Steel, 5.8" O.D. × 1.41" Wall, Austenitized 1525° F, I.D./O.D. Quenched, Tempered at 1080° F, (.357" Tensiles and Standard .394" "V" Notch Charpys Taken at O.D., Center and I.D. Wall Locations, Two Feet from Exit End of Tube.

| Tube | Test Position | .2% Yld. Str. KSI | Ultimate Ten. Str. KSI | Red. of Area % | El. % | Yld./Ten Ratio | R.C. Hardness | Charpy in./ft. | Charpy lbs. |
|---|---|---|---|---|---|---|---|---|---|
| O.D. | 1 | 139.5 | 157.8 | 55.9 | 17.2 | 0.88 | 34.0 | 41.0 | 43.0 |
| | 2 | 140.0 | 157.7 | 54.8 | 16.4 | 0.89 | 33.5 | 44.0 | 48.0 |
| | 3 | 136.4 | 155.6 | 52.5 | 17.2 | 0.87 | 33.5 | 40.5 | 47.0 |
| C. | 1 | 137.7 | 156.3 | 49.5 | 17.2 | 0.87 | 33.5 | 49.5 | 47.5 |
| | 2 | 140.7 | 159.0 | 52.9 | 15.7 | 0.88 | 33.5 | 51.0 | 48.0 |
| | 3 | 143.5 | 159.8 | 52.9 | 15.7 | 0.90 | 34.0 | 44.0 | 44.0 |
| I.D. | 1 | 138.0 | 157.6 | 51.3 | 16.4 | 0.88 | 34.0 | 47.5 | 49.0 |
| | 2 | 138.6 | 158.6 | 49.3 | 16.4 | 0.88 | 34.0 | 44.0 | 48.0 |
| | 3 | 139.1 | 157.9 | 52.5 | 17.2 | 0.88 | 34.0 | 45.0 | 50.0 |

C. 4340 Steel, 5.75" O.D. × 1.81" Wall, Austenitized 1525° F, I.D./O.D. Quenched, Tempered at 960° F, (.505" Tensiles and Standard .394" "V" Notch Charpys Taken at O.D., Center and I.D. Wall Locations, Two Feet from Exit End of Tube.

| Tube | Test Position | .2% Yld. Str. KSI | Ultimate Ten. Str. KSI | Red. of Area % | El. % | Yld. Ten. Ratio | R.C. Hardness | Charpy in./ft. | Charpy lbs. |
|---|---|---|---|---|---|---|---|---|---|
| O.D. | 1 | 167.4 | 182.2 | 47.0 | 27 | 0.92 | 39.0 | 20.0 | 20.0 |
| | 2 | 169.3 | 181.5 | 47.8 | 27 | 0.92 | 38.5 | 22.0 | 21.0 |
| | 3 | 169.4 | 183.7 | 42.9 | 25 | 0.92 | 39.0 | 21.0 | 20.0 |
| C. | 1 | 170.4 | 183.7 | 45.0 | 27 | 0.92 | 39.0 | 20.0 | 20.0 |
| | 2 | 170.9 | 182.9 | 46.4 | 26 | 0.93 | 39.5 | 22.0 | 21.0 |
| | 3 | 169.3 | 182.8 | 48.4 | 27 | 0.92 | 39.5 | 22.0 | 21.0 |
| I.D. | 1 | 169.6 | 184.2 | 41.8 | 25 | 0.92 | 39.0 | 23.0 | 22.0 |
| | 2 | 171.1 | 184.0 | 45.4 | 26 | 0.93 | 38.5 | 22.5 | 22.0 |
| | 3 | 171.3 | 183.8 | 46.3 | 27 | 0.93 | 39.0 | 20.5 | 21.0 |

Note that in all cases the Rockwell "C" hardness remains essentially constant at all test positions, indicating the hardness was uniform throughout the tube wall even at the exit end of the tube (i.e., the end opposite the nozzle 10 in FIGS. 1 and 2). Hardness measurements were also made across the tube wall at four separate locations on material representing the inlet, center and water exit ends of each tube. This data is shown in the following Table II:

TABLE II

Through Wall Hardness Spread at Entry, Center and Exit End of I.D./O.D. Quenched Tubing*

| Steel | Tube Size | Max. $R_c$ Spread | Average, $R_c$ |
|---|---|---|---|
| 4145 | 5.0" × O.D. × 1.44" Wall | 33 to 35 | 33.8 |
| 4150 | 5.81" O.D. × 1.41" Wall | 33 to 35 | 34.6 |
| 4340 | 5.75" O.D. × 1.81" Wall | 39 to 41 | 40.0 |

*Hardness surveys taken I.D. to O.D. on two slices from each location in tube. Traverses on each slice were taken at four locations, each 90° from the other.

Note again that the maximum Rockwell C hardness measurement spread is no greater than two points.

None of the tubes listed above cracked during the inside-outside quenching operation. Furthermore, all tubes and steel types were uniformly hardened through the wall and throughout the tube length. This, of course, is indicated in Tables I and II by the very small variation in hardness and tensile and impact properties shown between specimens representing the mid, inside diameter and outside diameter locations in each tube. The high yield to tensile ratios (i.e., higher than 0.85) confirm that the hardening achieved in each material was to full martensite prior to tempering.

Although the invention has been shown in connection with a certain specific embodiment, it will be readily apparent to those skilled in the art that various changes in method steps can be achieved to suit requirements without departing from the spirit and scope of the invention.

We claim as our invention;

1. A method for bringing a quenching medium into contact with both the inner and outer wall surfaces of heated metallic tubing during a quench cycle, which comprises the steps of initially introducing a quenching liquid into the interior of the tubing from an entrance end and pressurizing the same by restricting its flow at the exit end of the tube whereby, throughout the entire quench cycle, the quenching liquid will uniformly contact the entire inner wall surface of the tubing, and thereafter bringing the outer surface of the tubing into contact with a quenching liquid.

2. The method of claim 1 wherein the outer surface of the tubing is brought into contact with a quenching liquid by immersing the tubing in a quenching bath.

3. The method of claim 1 including the step of heating said tubing to a temperature of about 1525° F for 4 to 6 hours prior to quenching.

4. The method of claim 1 wherein quenching liquid is introduced into the interior of the tubing at least ten seconds prior to the outer surface of the tubing coming into contact with a quenching liquid.

5. The method of claim 1 wherein the quenching liquid is introduced into the interior of the tubing and pressurized by inserting into the opposite ends of the tubing two nozzles, one of which has a larger inner diameter than the other, and causing liquid to flow into the tubing through the nozzle of larger inner diameter.

* * * * *